US010161611B2

(12) United States Patent
Bernstein

(10) Patent No.: US 10,161,611 B2
(45) Date of Patent: Dec. 25, 2018

(54) ACTIVATING A CONTROL MODULE

(71) Applicant: Wearable Technology Limited, Stoney Stanton, Leicestershire (GB)

(72) Inventor: Mark Jonathan Bernstein, Stoney Stanton (GB)

(73) Assignee: Wearable Technology Limited, Stoney Stanton, Leicestershire (GB)

( * ) Notice: Subject to any disclaimer, the term of this patent is extended or adjusted under 35 U.S.C. 154(b) by 0 days.

(21) Appl. No.: 15/084,814

(22) Filed: Mar. 30, 2016

(65) Prior Publication Data

US 2016/0209016 A1 Jul. 21, 2016

Related U.S. Application Data

(63) Continuation-in-part of application No. 14/561,298, filed on Dec. 5, 214.

(51) Int. Cl.

| | |
|---|---|
| ***F21V 33/00*** | (2006.01) |
| ***F21V 23/04*** | (2006.01) |
| ***G05G 1/02*** | (2006.01) |
| ***F21S 9/02*** | (2006.01) |
| ***A41D 1/00*** | (2018.01) |

(Continued)

(52) U.S. Cl.

CPC ..... *F21V 23/0407* (2013.01); *A41D 1/002* (2013.01); *A41D 1/005* (2013.01); *F21L 4/08* (2013.01); *F21S 9/02* (2013.01); *F21V 23/001* (2013.01); *F21V 23/0471* (2013.01); *F21V 23/0492* (2013.01); *F21V 33/0008* (2013.01); *G05G 1/02* (2013.01); *A41B 1/08* (2013.01); *A41D 1/02* (2013.01); *A41D 1/04* (2013.01); *A41D 19/0024* (2013.01); *F21W 2111/10* (2013.01); *F21Y 2115/10* (2016.08); *Y10T 29/49002* (2015.01)

(58) Field of Classification Search

CPC . A41D 1/04; A41D 1/02; A41D 1/002; A41D 1/005; A41B 1/08; F21V 23/0407; F21V 23/0471; F21V 33/0004; F21V 33/0008; F21W 2121/06; F21Y 2111/10; F21Y 2115/10; G05G 1/02

USPC ..... 362/103

See application file for complete search history.

(56) References Cited

U.S. PATENT DOCUMENTS 4,709,307 A * 11/1987 Branom ..... A41D 27/085 362/103
5,613,756 A * 3/1997 Allen ..... A41D 27/085 362/103

(Continued)

FOREIGN PATENT DOCUMENTS

GB 2319164 A 5/1998
GB 2417186 A 2/2006

(Continued)

*Primary Examiner* — Zheng Song
(74) *Attorney, Agent, or Firm* — James Creighton Wray; Meera P. Narasimham

(57) ABSTRACT

A control module (105) is supported within an item of clothing. The control module is located within a pocket (503). A visual indicator (1201) is pressed on the jacket at a position in front of the activation button on the control module. The activation button has a surface area that covers at least 40% of a surface area of the control module. In this way, it is possible for the control module to move within the pocket while still facilitating activation and deactivation upon pressing the visual indicator.

14 Claims, 12 Drawing Sheets

(51) Int. Cl.

| | |
|---|---|
| ***F21L 4/08*** | (2006.01) |
| ***F21V 23/00*** | (2015.01) |
| *A41B 1/08* | (2006.01) |
| *A41D 1/02* | (2006.01) |
| *A41D 1/04* | (2006.01) |
| *A41D 19/00* | (2006.01) |
| *F21W 111/10* | (2006.01) |
| *F21Y 115/10* | (2016.01) |

(56) References Cited

U.S. PATENT DOCUMENTS 6,964,493 B1 11/2005 Whitlock
D635,887 S * 4/2011 Snarr ..... D11/131
2002/0044052 A1* 4/2002 Stewart ..... A41D 13/01 340/475
2002/0163800 A1* 11/2002 Hansen ..... A44B 1/04 362/103
2010/0251453 A1 10/2010 Chen
2011/0025195 A1* 2/2011 Govender ..... A41D 27/085 313/504
2011/0199779 A1* 8/2011 Chu ..... F21V 33/0008 362/551
2011/0235311 A1* 9/2011 Stone ..... A41D 13/01 362/106
2012/0099298 A1* 4/2012 Hsu ..... A41D 27/085 362/103
2014/0268685 A1* 9/2014 McLisky ..... A41D 13/01 362/108
2015/0267911 A1* 9/2015 Cushnie ..... F21V 33/0008 362/558
2016/0021945 A1* 1/2016 Richmond ..... A41D 13/0051 219/211

FOREIGN PATENT DOCUMENTS

GB 2477822 A 8/2011
GB 2494917 A 3/2013

* cited by examiner

ACTIVATING A CONTROL MODULE

CROSS REFERENCE TO RELATED APPLICATIONS

This application is a continuation in part of U.S. patent application Ser. No. 14/561,298 filed on 5 Dec. 2014, which in turn claims priority from United Kingdom Patent Application No. 13 23 058.6 filed 24 Dec. 2013, the entire disclosure of which is incorporated herein by reference in its entirety.

BACKGROUND OF THE INVENTION

1. Field of the Invention

The present invention relates to a wearable item having an inside surface and an outside surface.

The present invention also relates to a method of activating a control module supported within an item of clothing.

2. Description of the Related Art

It is known for wearable items to be provided with electrically active devices and to be provided with a control module so as to provide energy to these devices. In addition, it is known for control modules to include activation buttons, such that the module can be activated during use and then deactivated, primarily to conserve electrical energy.

A module constrained within a pocket within a jacket is disclosed in US 2016/0021945. The pocket includes a zipper allowing the module to be removed from said pocket so that activation and deactivation of the button may occur. However, it is appreciated that in some environments it may be difficult to remove the item from an internal pocket, thus making activation and deactivation difficult while a user continues to wear the jacket.

An alternative approach is shown in U.S. Pat. No. 4,164,008, in which activation may be performed while a module continues to be restrained within a pocket. However, a button of this type may be difficult to locate and is therefore given a significant length so as to allow it to be felt by a user. However, a problem with this approach is that a user may still encounter difficulties in terms of locating the button and the button itself may be activated or deactivated accidentally and could, under some circumstances, result in damage.

BRIEF SUMMARY OF THE INVENTION

According to a first aspect of the present invention, there is provided a wearable item having an inside surface and an outside surface, comprising: a plurality of material elements connected by stitched seams; at least one electrically active device; a control module having a first surface and an opposing second surface; an electrical conductor for conducting electrical power from said control module to said active device; a pocket configured to receive said control module; an activation button covering more than 40% of the surface area of said first surface; and a visual indicator on said outside surface at the position of said pocket, such that said visual indicator indicates the position of a portion of said activation button when said control module is present within said pocket.

In an embodiment, the control module has the shape of a regular cuboid, wherein: said first surface and said opposing second surface are larger than a third surface and an opposing second surface; and said third surface and said fourth surface are larger than a fifth surface and an opposing sixth surface. The activation button may itself be substantially rectangular.

According to a second aspect of the present invention, there is provided a method of activating a control module supported within an item of clothing, comprising the steps of; locating said control module within a pocket; and pressing a visual indicator on said jacket at a position in front of an activation button on said control module, wherein: said control module has a first surface defining a first surface area and an opposing second surface; said activation button as a second surface area; and said second surface area of said button covers at least 40% of said surface area of said first surface of said control module.

In an embodiment, the control module activates a light emitting diode in response to detecting an activity performed by someone wearing the item.

DETAILED DESCRIPTION OF EXAMPLE EMBODIMENTS

FIG. 1

Figure 1:
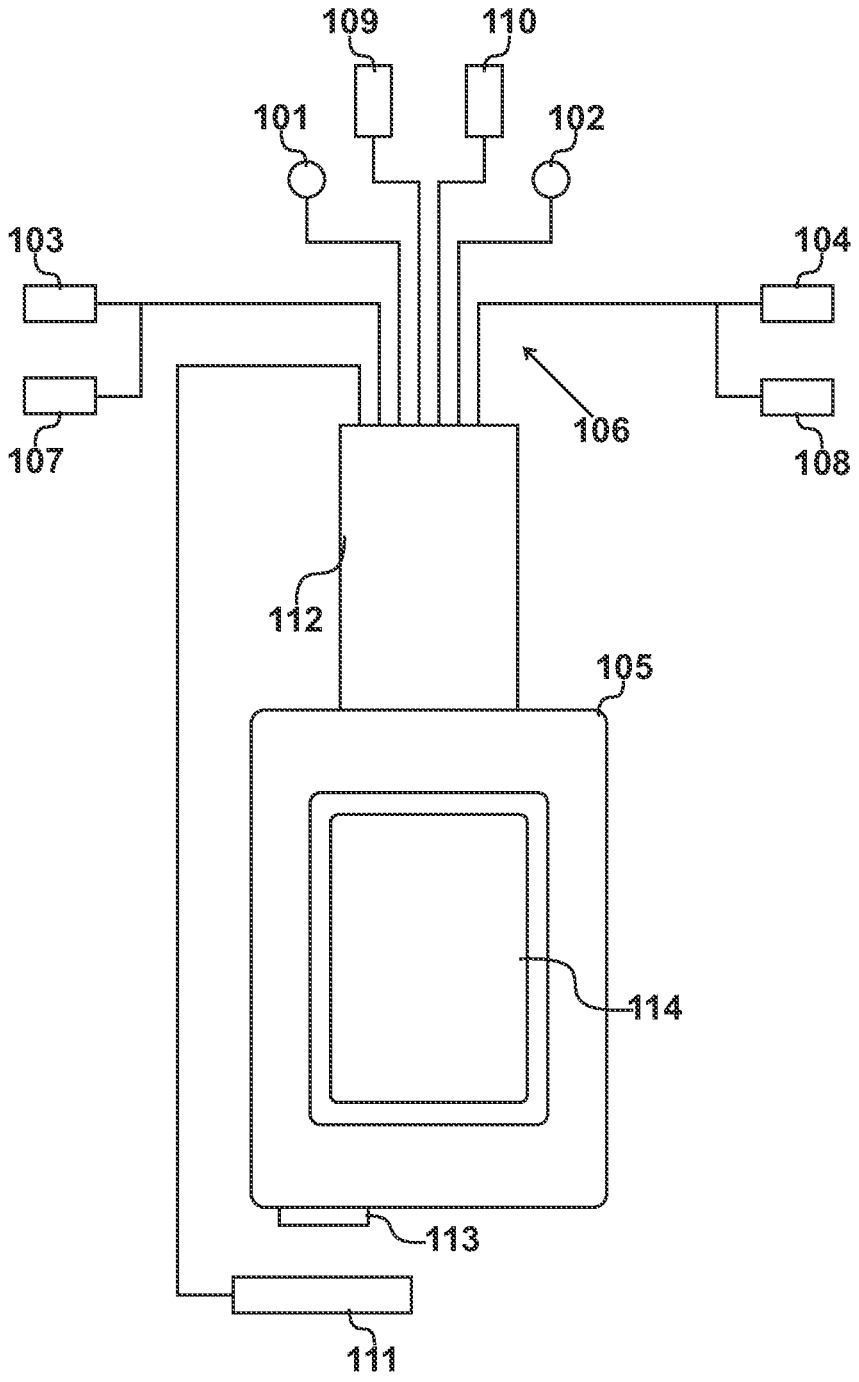
FIG. 1 shows an illumination system.

An illumination system is illustrated in FIG. 1 that has been constructed with a right detection device 101, a left detection device 102, a right indicating device 103, a left indicating device 104, a control module 105 and a wiring loom 106. The wiring loom connects the control module 105 to the indicator devices 103, 104 and to the detection devices 101, 102.

The illumination system of FIG. 1 is shown as a front view such that, from the perspective of the user, detection device 101 would be on the user's left; but actually shown to the right in FIG. 1.

In use, the raising of a cyclist's right arm is detected by detection device 101, possibly taking the form of rocker switch, thereby closing a circuit, such that it is possible for this condition to be detected by circuitry contained within the control module 105. The circuitry will then energize indicating device 103, such that indicating device 103 is seen to flash. In an embodiment, indicating device 103 includes one or more amber colored light emitting diode (LED) devices. Thus, upon raising a right arm, indicating device 103 is caused to flash in a way that would be recognizable to a motorist as an indication to the effect that the cyclist intends to turn right.

In an embodiment, a second right indicating device 107 is provided, such that the first indicating device 103 may be positioned to the front of the jacket and the second indicating device 107 may be positioned on the back of the jacket.

Thus, left indicating device 104 may be positioned on the front of a jacket, with a second left indicating device 108 being positioned on the back of the jacket. Thus, in response to detection device 102 detecting that the left arm has been raised, both indicating devices 104 and 108 (in the form of LED devices) will be energized, such that amber flashes are seen on the left side of the cyclist.

In an embodiment, to improve overall visibility, a first permanent front LED array 109 is provided along with a second permanently lit front array 110.

A permanently lit rear array 111 is also provided, preferably including a plurality of red LED devices.

In an embodiment, the loom 106 is connected to the control module 105 by a detachable plug 112 that may be attached to and then detached from an appropriately configured socket within control module 105.

In addition to housing a control circuit, the control module also contains a battery of energizing cells. These cells may take the form of replaceable cells or they make take the form of rechargeable cells. In the embodiment of FIG. 1, rechargeable cells are included that are recharged via a recharge socket 113. In an embodiment, recharge socket 113 takes the form of a conventional mobile device charging port, such as a USB socket. In this way, it is possible for the rechargeable cells to be recharged using readily available recharging equipment, as used for the charging of other mobile devices such as mobile cellular telephones.

A toggle button 114 is included for energizing and de-energizing the device manually, as detailed further herein.

FIG. 2

Figure 2:
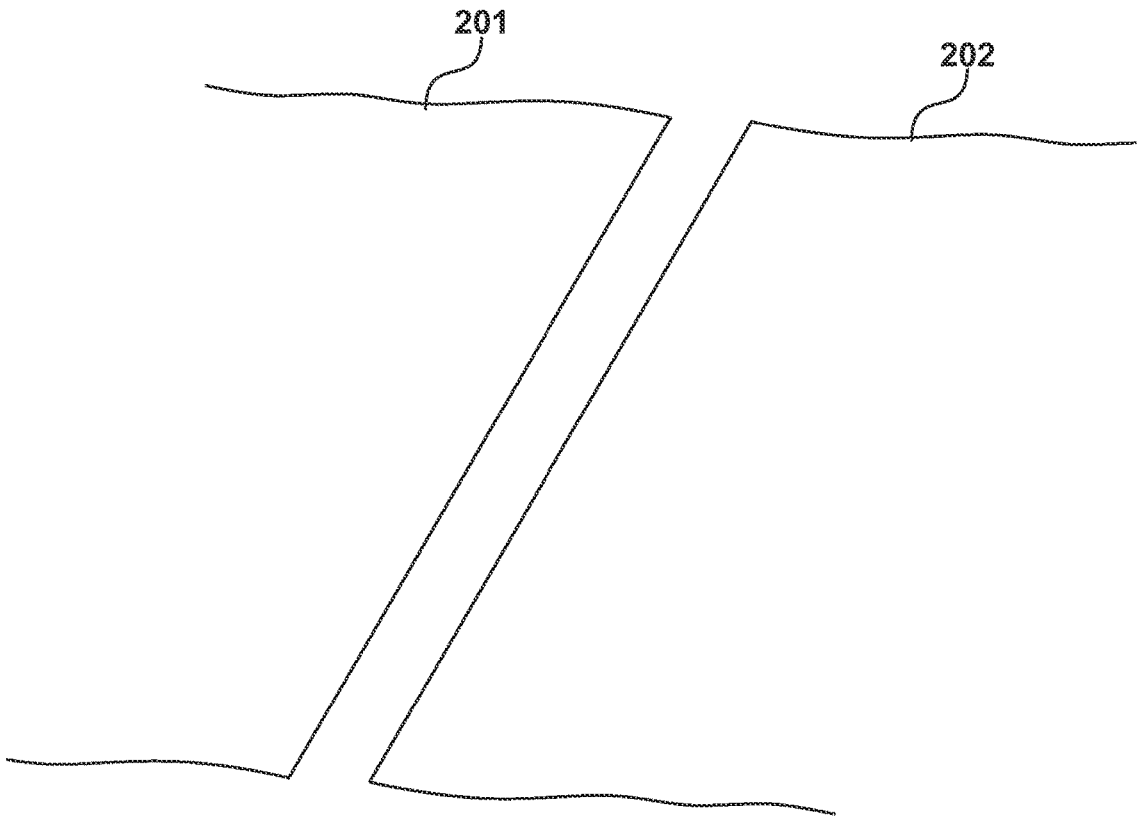
FIG. 2 illustrates a first stage in an assembly process.
Figure 3:
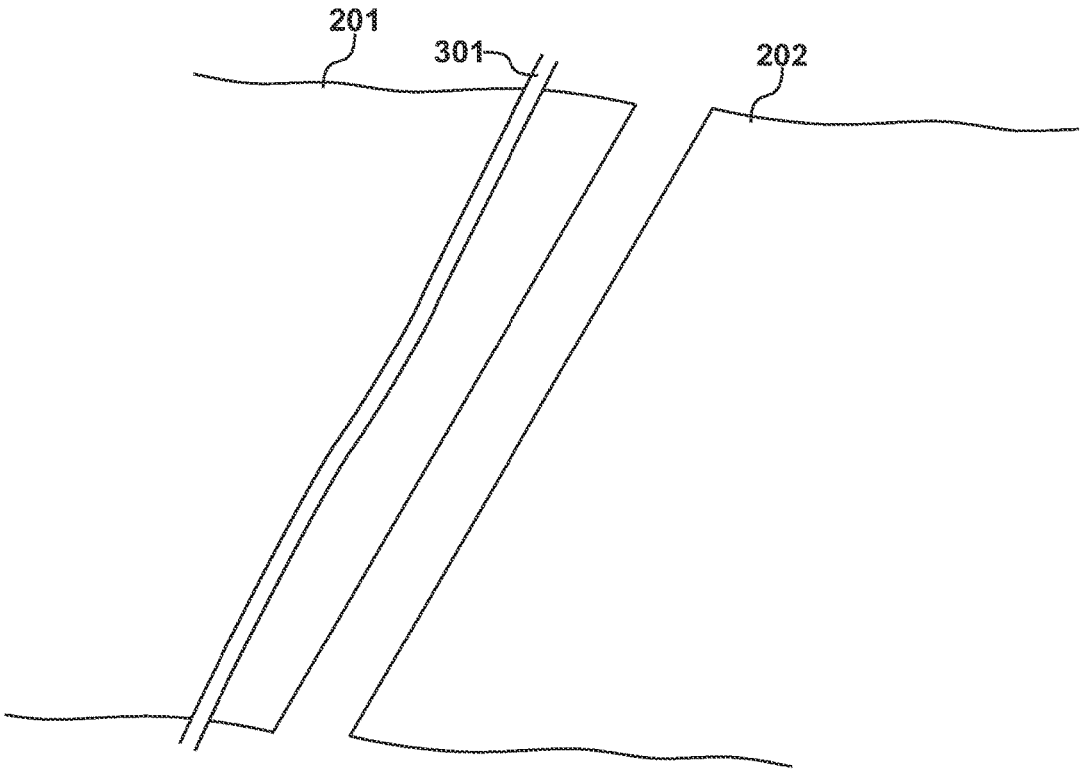
FIG. 3 shows a second stage of said assembly process.

In an embodiment, the item of clothing is assembled from material components. As illustrated in FIG. 2, this includes a first material component 201 and a second material component 202. These are configured to be joined together by stitches thereby forming a seam. To construct the jacket, many seams of this type are required. Given that several layers of material are included at the seams, the seams represent a relatively strong region of the jacket, less susceptible to being strained in response to stresses applied thereto during the use of the jacket.

It has been appreciated that wiring loom 106 may become damaged or detached if care is not taken to ensure that the loom is secured to the jacket. Thus, at least a portion of the wiring loom may be secured to the item within one or more of these seams.

FIG. 3

Having positioned component 201 in place, alongside material component 202, a section 301 of the wiring loom 106 is placed over material component 201. In this embodiment, the section 301 is held in place exclusively by the stitching used to connect the individual material components.

FIG. 4

Having located section 301 over material component 201, material component 202 is then laid over the combination to provide a region of overlap, indicated by region 401.

Figure 4:
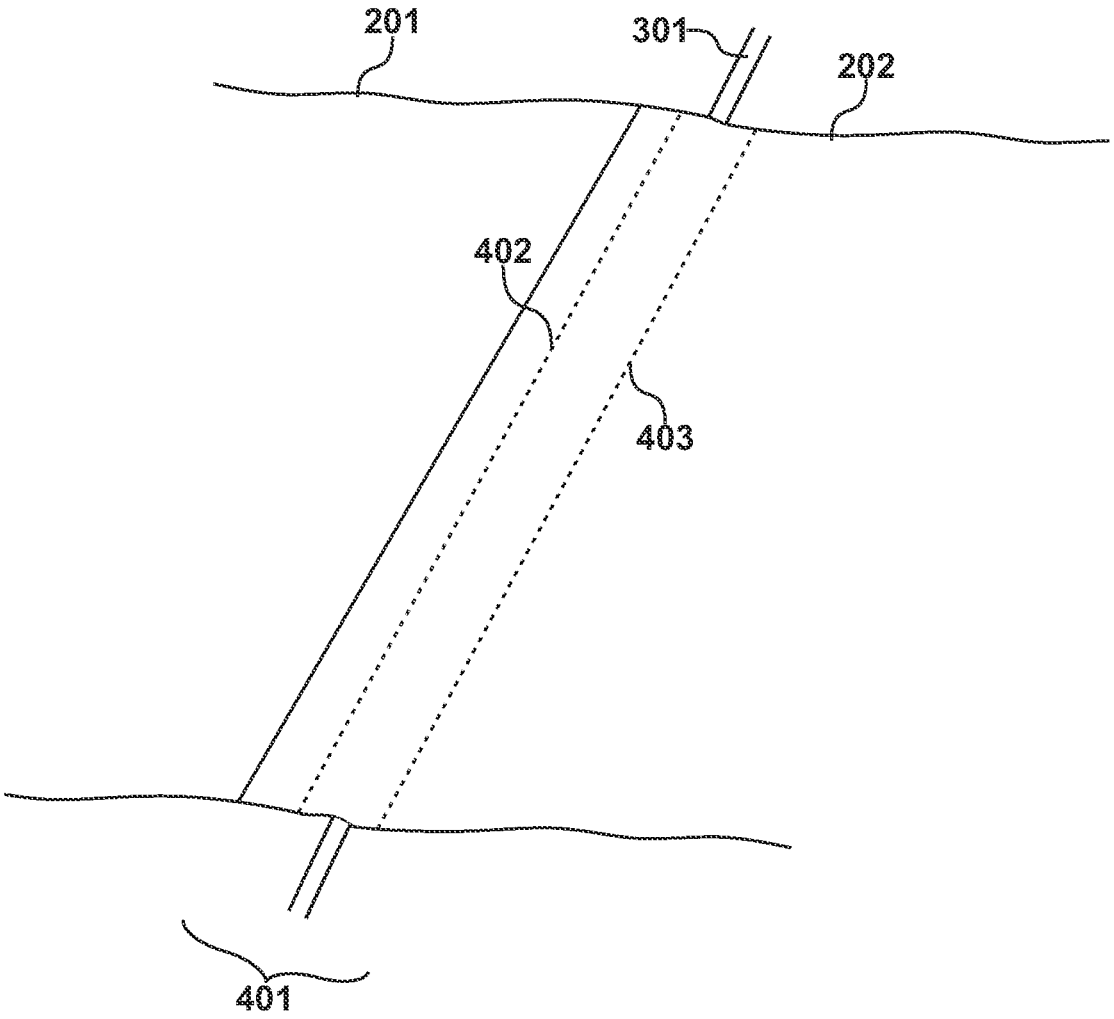
FIG. 4 shows a third stage of the assembly process.

A seam is then formed, so as to hold material component 201 securely to material component 202 by a first row of stitches 402 and a second row of stitches 403. As shown in FIG. 4, the loom section 301 is held securely between said first row of stitches 402 and said second row of stitches 403. The example shown in FIG. 4 may be considered as a plain seam. In an alternative approach, a French seam is deployed, so that raw edges of the material are fully enclosed.

Thus, the electrical conductor may be a wire secured substantially within the seams.

FIG. 5

In an embodiment, the item of clothing takes the form of a jacket. Furthermore, in an embodiment, the jacket is constructed from a plurality of layers. Thus, an internal layer or mesh 501 may be attached to the external outside layer 502, possibly using high visibility fluorescent material, thereby increasing the visibility of the jacket during the daytime.

In accordance with an aspect of the present invention, the jacket is provided with a pocket 503 for receiving the control module 105, as described with respect to FIGS. 9, 10, 11 and 12.

In this embodiment, pocket 503 is accessible from an inside surface 504 but is activated via an interaction with an outside surface 505 of the jacket.

FIG. 6

Having located loom 106 within the jacket such that, wherever possible, the wiring loom is secured within seams forming the jacket, it is necessary to connect the detection devices 101, 102 and the indicating devices 103, 104 etc.

Figure 6:
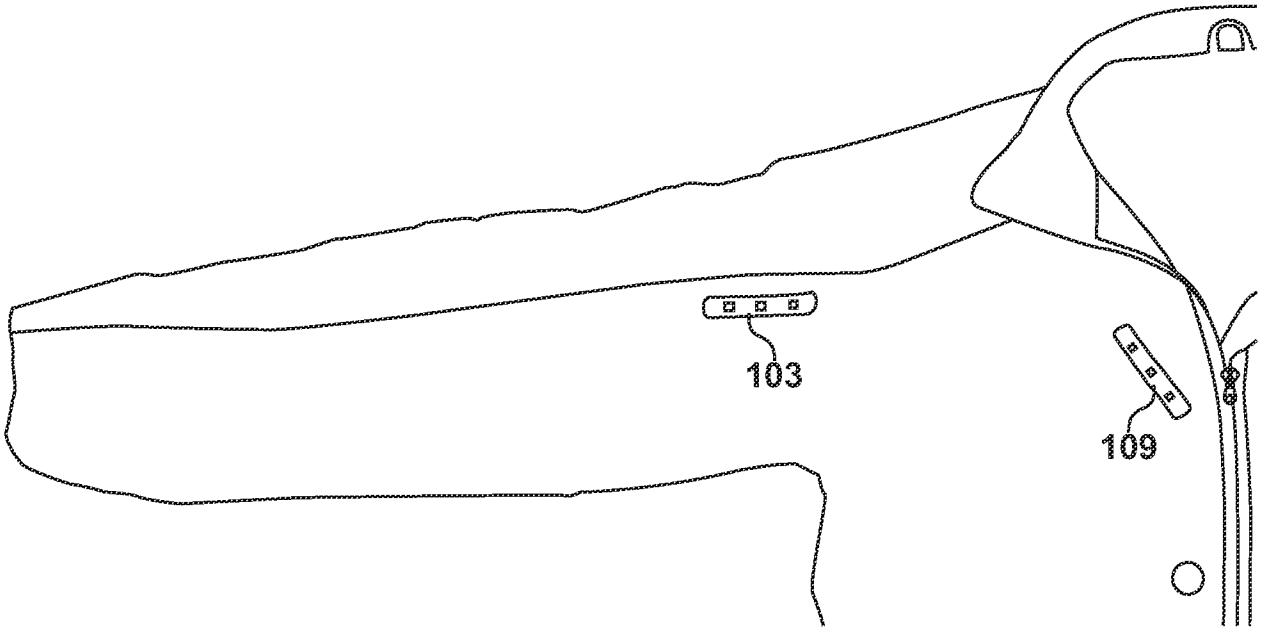
FIG. 6 illustrates the application of indicators.

As shown in FIG. 6, indicating device 103 is located on the front upper arm of the jacket. Indicator device 109 is located towards the collar of the jacket.

In this embodiment, each indicator device includes three LED devices configured to emit amber light when energized. Thus, in response to detection device 101 detecting that the right arm has been raised, indicating device 103 will be energized periodically in order to create a flashing amber light. A similar device, device 107, is provided to the rear of the right arm.

In an embodiment, LED array 109 is configured to emit white light and remains constantly energized to illuminate the cyclist.

FIG. 7

Figure 7:
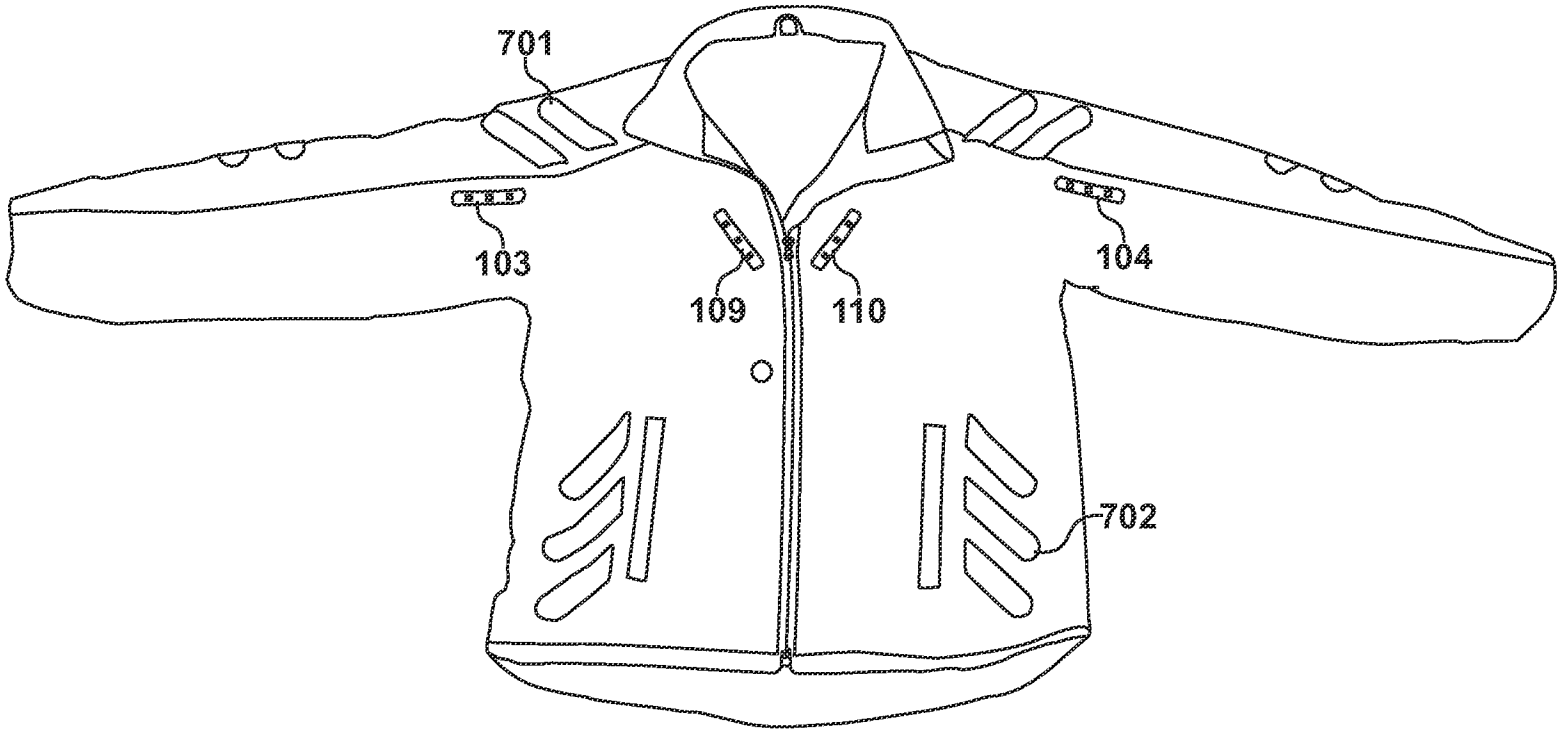
FIG. 7 shows further items added to a jacket.

Indicating device 103 and illuminating LED array 109 are also shown in FIG. 7. FIG. 7 shows the full jacket and therefore includes indicating device 104 and illuminating array 110. Each of these devices has been attached to the jacket and in an embodiment, the devices comprise a plurality of light emitting diodes.

In this embodiment, reflective materials 701 have been added to the arms and similar reflective materials 702 have been added to the torso. These reflective materials 701, 702 improve night time visibility and may include retro-reflective materials.

FIG. 8

Figure 8:
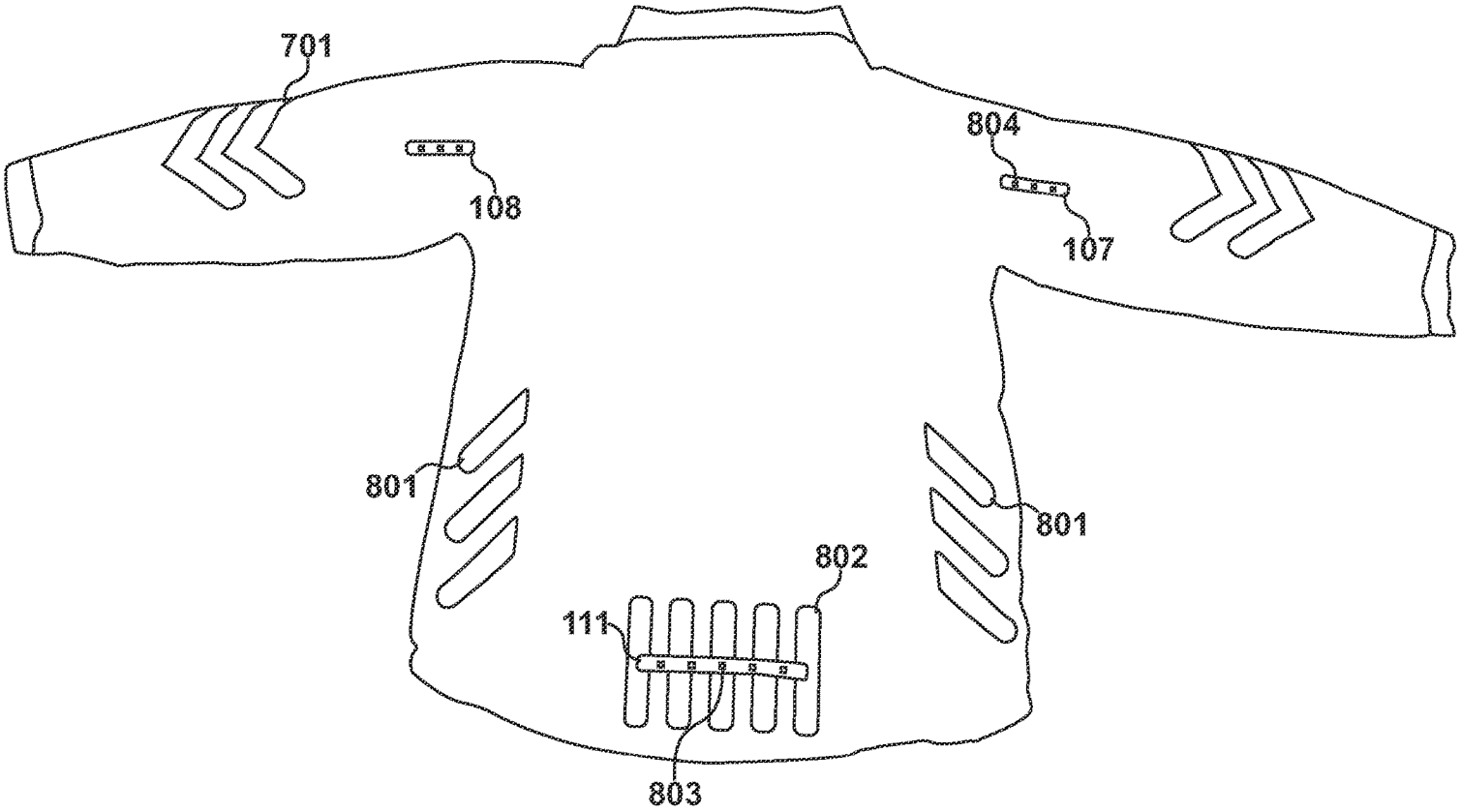
FIG. 8 illustrates items added to the rear of a jacket.

The rear of the jacket shown in FIG. 7 is illustrated in FIG. 8. Rear reflective elements 801 are included to the sides of the jacket and additional reflective elements 802 are included towards the bottom of the jacket. Illuminating array 111 is also included towards the bottom of the jacket and comprises, in this example, five LED devices 803 configured to emit red light.

FIG. 8 also illustrates the position of the left rear indicating device 108 and the right rear indicating device 107. Again, the left rear indicator 108 and the right rear indicator 107 include, in this example, three LED devices 804 configured to emit amber light. Thus, when the left arm is raised, indicating device 108 will flash and when the right arm is raised, indicating device 107 will flash.

The jacket is an example of a wearable item for enhancing visibility and the invention could be applied to other items, such as a vest, a shirt, a jacket, a glove or a rucksack. Material elements are connected together by stitched seams and at least one illuminating device is provided along with a source of electrical power. A conductor conducts electrical power from the source of electrical power to the illuminating device and a substantial portion of the conductor may be secured within the seams.

FIG. 9

Figure 5:
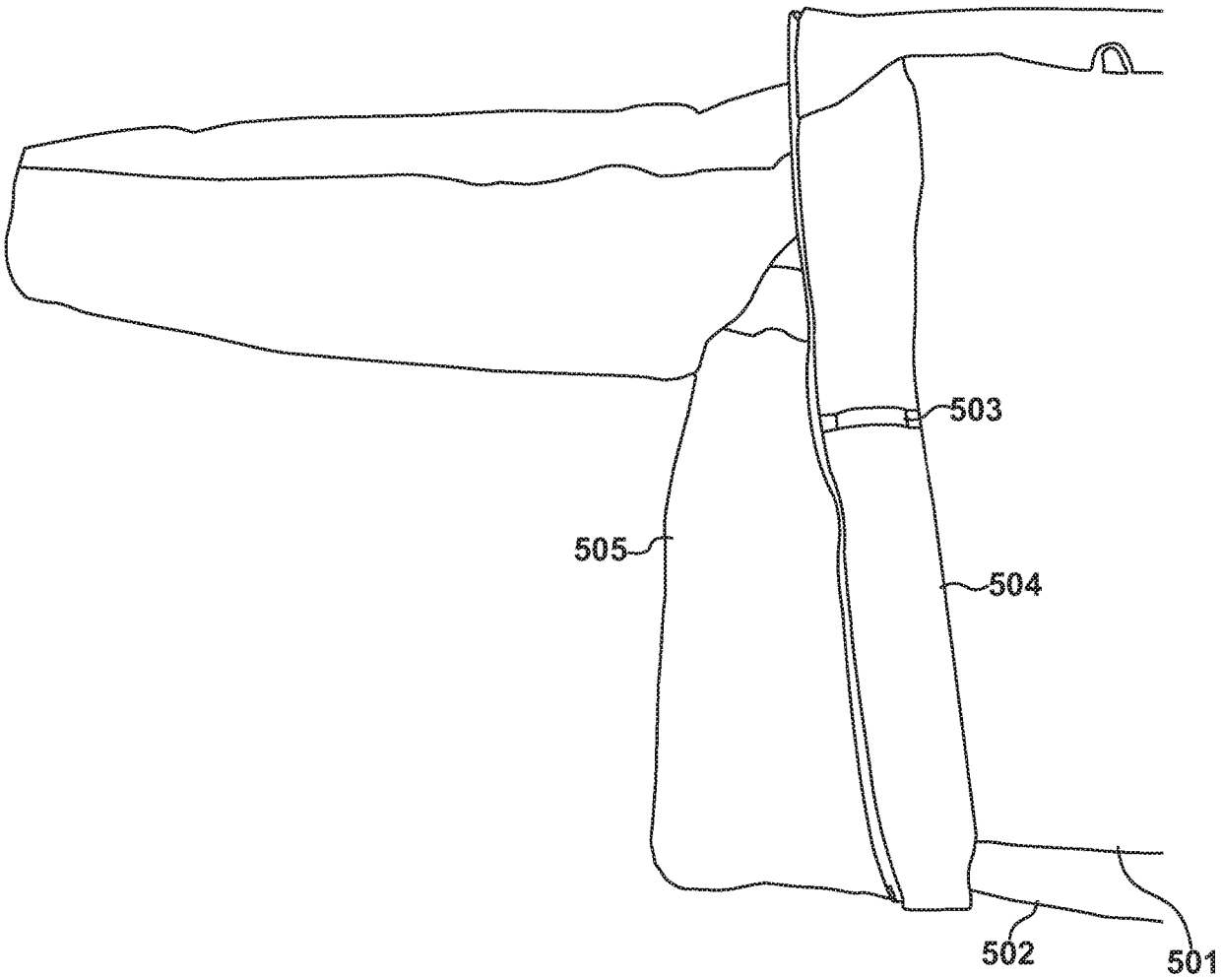
FIG. 5 illustrates the construction of a jacket.
Figure 9:
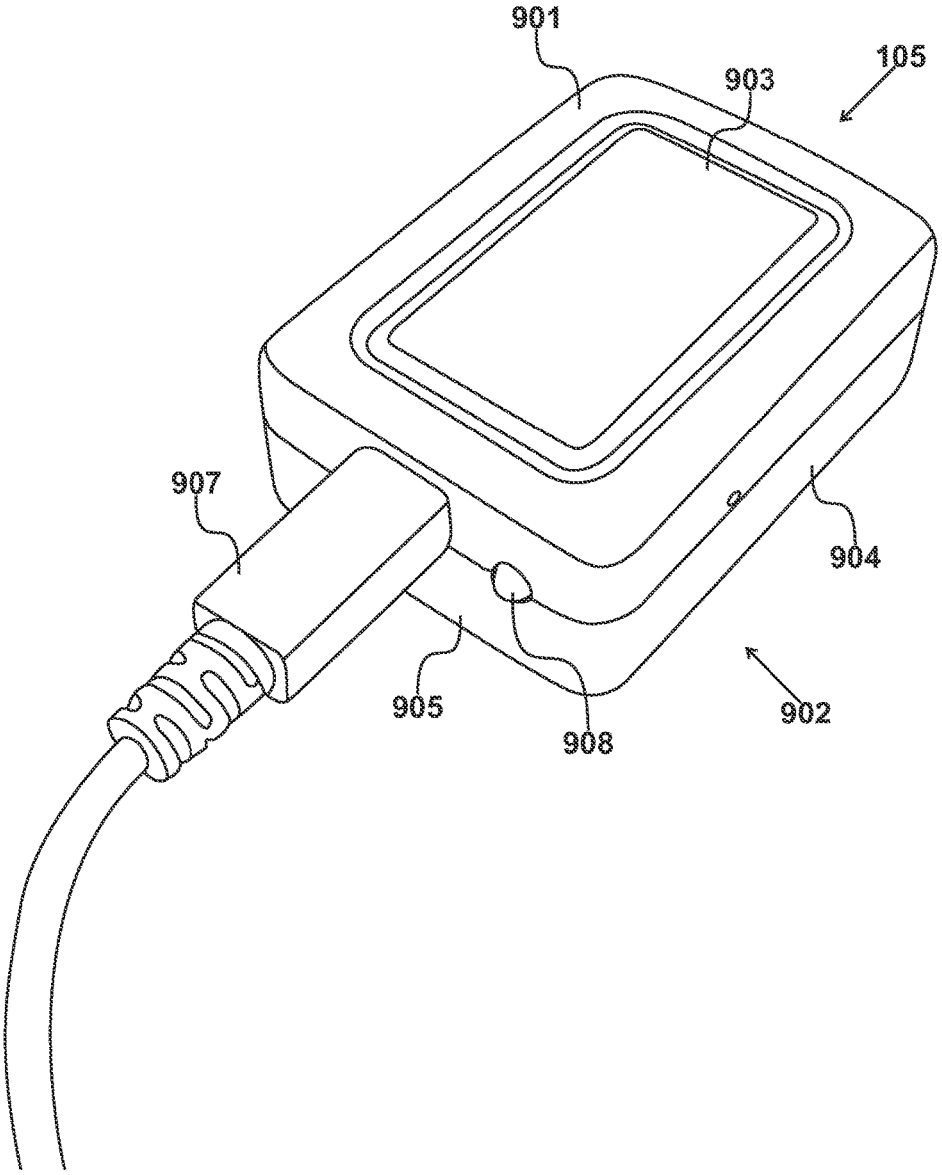
FIG. 9 shows the control module identified in FIG. 1.
Figure 10:
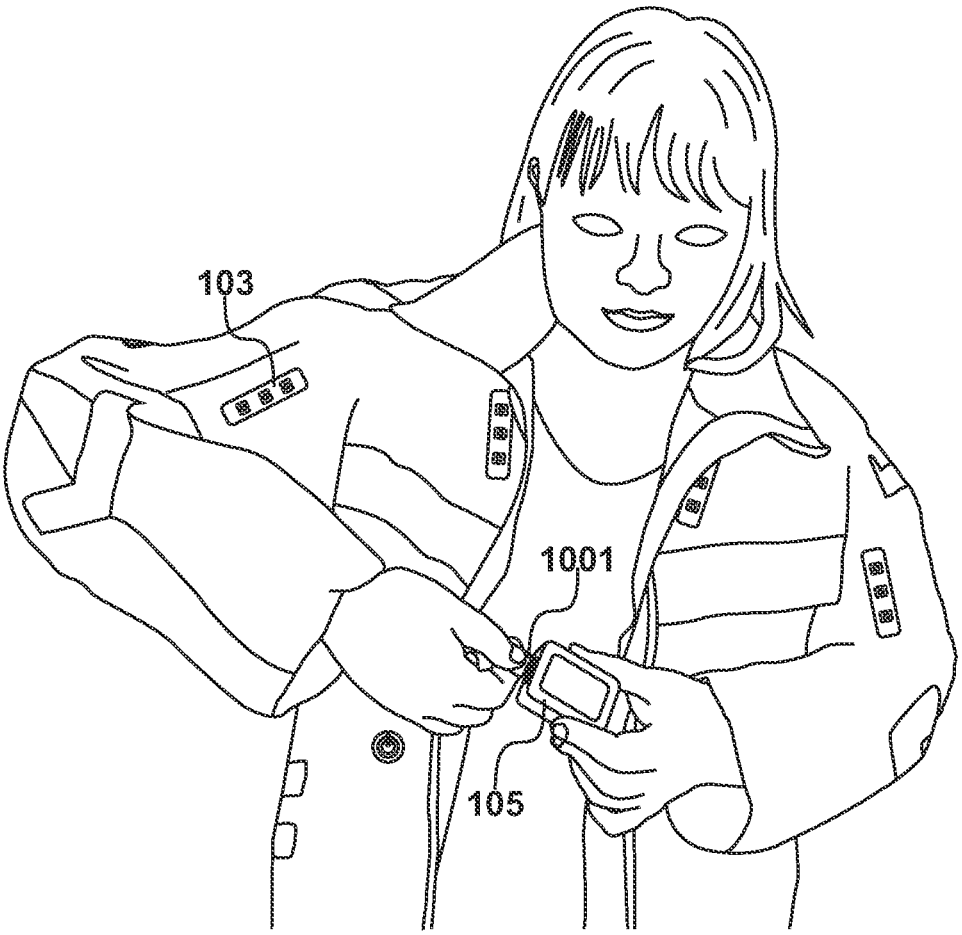
FIG. 10 shows the control module being connected to a wiring loom.
Figure 11:
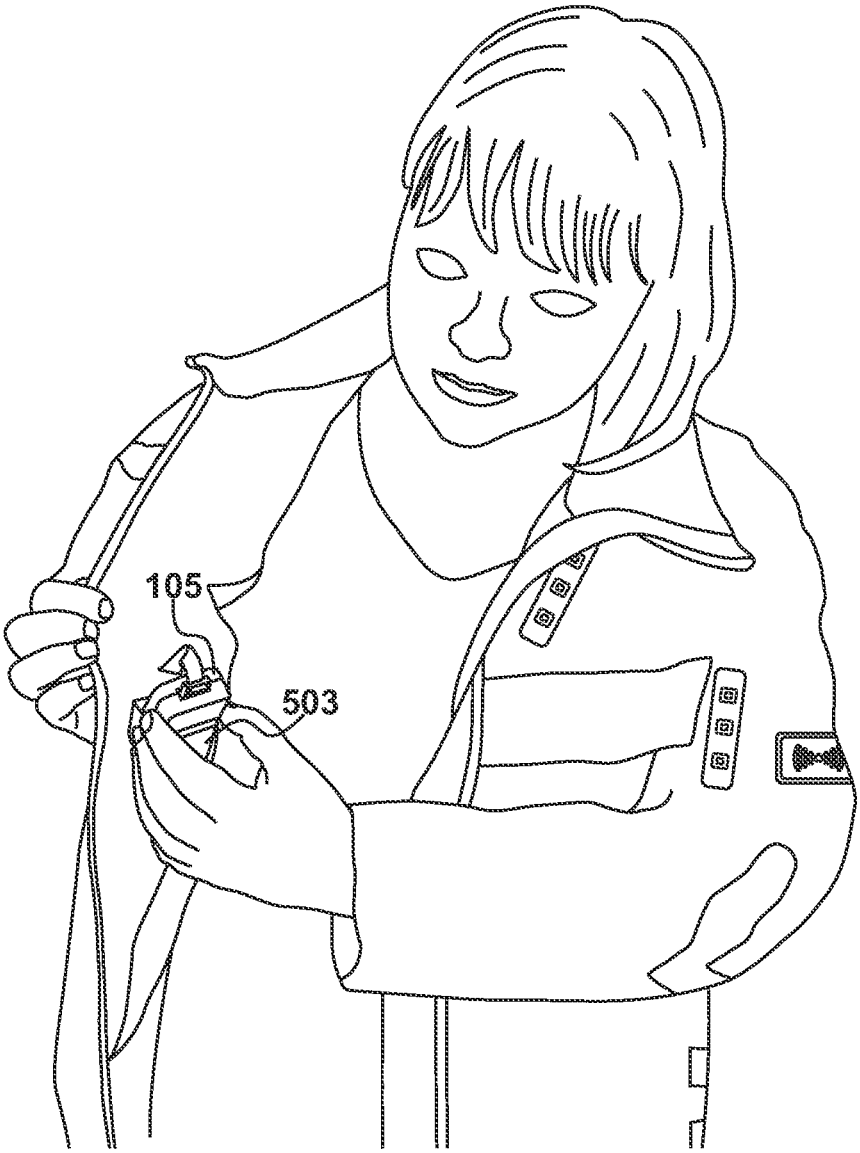
FIG. 11 shows the control module being inserted into an internal pocket.

Control module 105 is shown in FIG. 9. As described herein, it is configured for use with a wearable item having inside surface 504 and an outside surface 505. To construct the wearable item, a plurality of material elements are connected by stitched seams and the item includes at least one electrically active device, such as a light emitting diode or a plurality of light emitting diodes as previously described. The control module 105 as a first surface 901 and an opposing second surface 902 (not visible in FIG. 9). In the wearable item, an electrical conductor is provided for conducting electrical power from the module 105 to the active device. Furthermore, as shown in FIG. 5, a pocket is configured to receive the control module.

In accordance with an aspect of the present invention, an activation button 903 is provided that covers more than 40% of the surface area of the first surface 901. Furthermore, a visual indicator is provided on the outside surface 505 of the item at a position of the pocket. In this way, the visual indicator indicates the position of a portion of the activation button when said control module is present within the pocket. In this way, the size of the activation button relative to the size of the module itself allows a loose fit within pocket 503, such that the control module may move with respect to the visual indicator on the jacket itself. However, given the size of the button, even when this movement takes place, a significant portion of the button 903 will still be located adjacent to the visual indicator, thereby facilitating activation and deactivation without removing the control module 105 from the pocket 503.

In embodiment shown in FIG. 9, the activation button 903 is positioned substantially centrally within the first surface 901.

In this embodiment, the control module has the shape of a regular cuboid and in this configuration, the first surface 901 and the opposing second surface 902 are larger than a third surface 904 and an opposing fourth surface. Furthermore, in this configuration, the third surface 904 and the opposing fourth surface are larger than a fifth surface 905 and an opposing sixth surface. In this embodiment, the activation button 903 is substantially rectangular. Furthermore, the activation button operates as a toggle, such that a first press may activate the control module and a second press may deactivate the control module. However, in an alternative embodiment, a plurality of presses may result in the control module cycling through various modes of operation, such that LED devices may flash at different rates or be permanently lit.

In the embodiment shown in FIG. 9, the control module includes rechargeable batteries that receive charge via a conventional USB cable 907. As is known in the art, an LED device 908 may glow red when the device is charging and may glow green after the device has become fully charged.

FIG. 10

After the control module 105 has been charged, it is connected to a wiring loom connector 1001 so as to be in a position to power the active devices, such as LED indicating device 103, forming part of the wearable item. After being connected in this way, the control module has not been activated and will remain in a minimal energy dissipation state until manually activated in accordance with an aspect of the present invention.

FIG. 11

In accordance with an aspect of the present invention, for activating a control module supported within an item of clothing, such as a jacket, the control module 105 is located within pocket 503. In the embodiment, the control module 105 is located within an inside pocket, such that this pocket 503 is obscured when the item is worn.

FIG. 12

Figure 12:
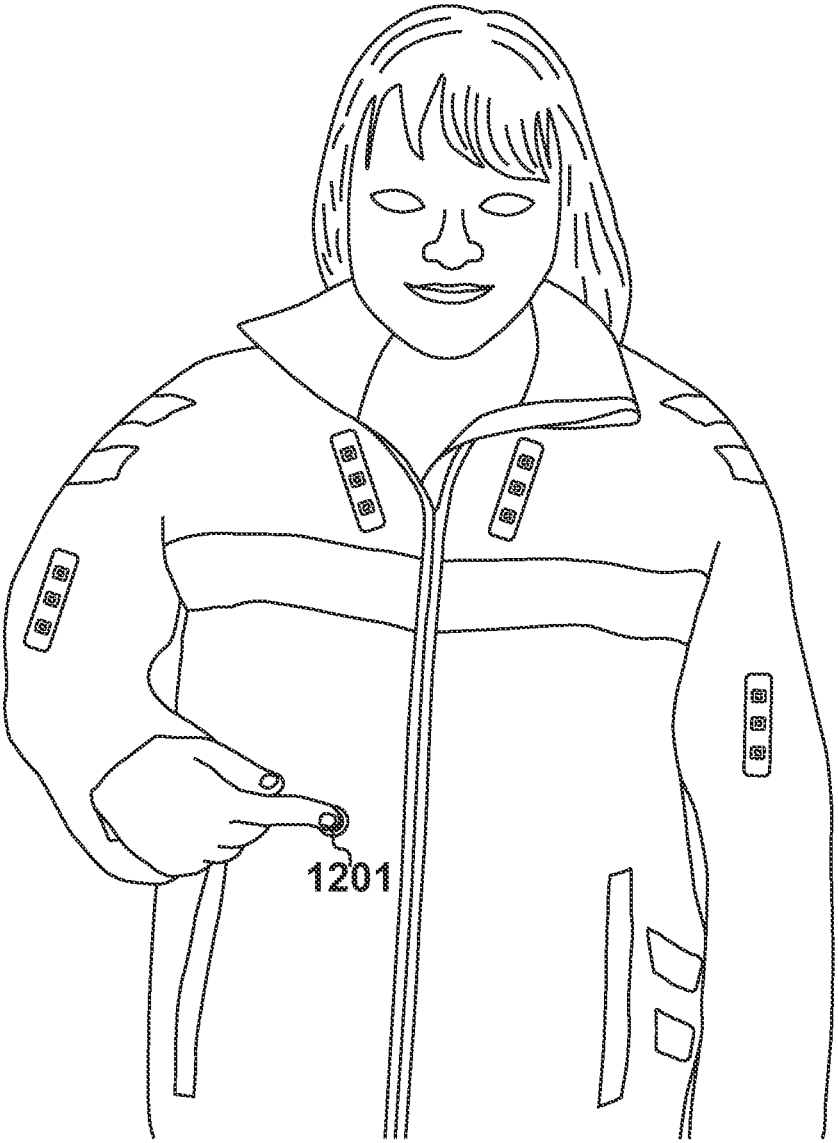
FIG. 12 shows the control module being activated from outside the jacket.

After locating the control module 105 within pocket 503, the item of clothing may be secured, as illustrated in FIG. 12. At the location of the internal pocket, a visual indicator 1201 is provided which is configured to line up with the position of the activation button 903. As previously described, the activation button 903 is relatively large compared to the size of the control module as a whole. In this way, it is possible for the control module 105 to move within pocket 503 while at the same time ensuring that a portion of the activation button 903 continues to line up with the visual indicator 1201.

Thus, the control module 105 is located within pocket 503. Thereafter, it is possible to press visual indicator 1201 on the jacket at a position in front of the activation button on the control module. Activation will always occur, because the control module as a first surface defining a first surface area and an opposing second surface. The activation button has a second surface area and the second surface area of this button covers at least 40% of the surface area of the first surface area of the control module.

I claim:

1. An apparatus comprising:

a wearable item of clothing having an inside surface and an outside surface, comprising:

a plurality of material elements connected by stitched seams;

at least one electrically active device including plural LED lighting arrays on the outside surface;

a control module having a first surface and an opposing second surface;

an electrical conductor for conducting electrical power from said control module to said at least one electrically active device;

an internal pocket accessible from the inside surface of the wearable item and configured to receive said control module, wherein the internal pocket is obscured when the item of clothing is worn;

an activation button having a first size and covering more than forty percent of a surface area of said first surface; and a visual indicator on said outside surface of the wearable item of clothing at a position of said internal pocket, said visual indicator configured for indicating a position of said activation button and having a second size, wherein:

said second size of the visual indicator is smaller than said first size of the activation button, such that said visual indicator has a total surface area smaller than a surface area of said activation button such that said control module is movable within the internal pocket and is movable with respect to said visual indicator on said wearable item; and wherein said visual indicator is configured for indicating a position of a portion of said activation button when said control module is present within said internal pocket, such that a significant portion of said activation button is still located adjacent said visual indicator even if said control module moves with respect to said visual indicator within the pocket, wherein pushing on the smaller visual indicator permanently located on the wearable item of clothing pushes on the larger activation button and activates or deactivates the control module irrespective of where the control module is in the pocket.

2. The wearable item of claim 1, wherein said pocket is accessible from said inside surface.

3. The wearable item of claim 1, wherein said electrical conductor is retained within said stitched seams.

4. The wearable item of claim 1, further comprising activation devices configured to cause said light emitting diode to flash periodically.

5. The wearable item of claim 1, wherein said activation button is positioned substantially centrally within said first surface.

6. The wearable item of claim 1, wherein said control module has a shape of a regular cuboid.

7. The wearable item of claim 6, wherein said activation button is substantially rectangular.

8. The wearable item of claim 1, wherein said activation button is a toggle, such that a first press activates said control module and a second press deactivates said control module.

9. The wearable item of claim 1, wherein said control module includes a re-chargeable battery.

10. A method of activating a control module supported within a wearable item of clothing having at least one electrically active device including plural lighting arrays on an outside surface of the item of clothing, comprising the steps of:

providing a large activation button on said control module;

locating said control module within an inside pocket within said item of clothing, wherein the inside pocket is obscured when the item of clothing is worn; and pressing a visual indicator on the outside surface of said item of clothing, wherein the visual indicator is smaller than said activation button and is configured for indicating a location of said activation button at a position in front of said activation button on said control module, wherein:

said control module has a first surface defining a first surface area and an opposing second surface;

said activation button has a second surface area;

said second surface area of said activation button is larger than a total surface area of said visual indicator; and said second surface area of said button covers at least forty percent of said first surface area of said first surface of said control module, such that said control module is movable within said pocket with respect to said visual indicator on said item of clothing while ensuring that a portion of the activation button continues to line up with said visual indicator;

wherein pushing on the smaller visual indicator permanently located on the wearable item of clothing pushes on the larger activation button and activates or deactivates the control module irrespective of where the control module is in the pocket.

11. The method of claim 10, further comprising the step of re-charging a re-chargeable battery contained within said control module prior to said locating step.

12. The method of claim 10, wherein said locating step further comprises locating said control module within the inside pocket, such that said inside pocket is obscured when the item of clothing is worn.

13. The method of claim 10, wherein said control module activates said LED lighting arrays in response to detecting an activity performed by a person wearing the item of clothing.

14. The method of claim 10, wherein the visual indicator communicates with the activation button by pressing said visual indicator on said item of clothing thereby pressing a front of said activation button.

* * * * *